US005174343A

United States Patent [19]

Rood

[11] Patent Number: 5,174,343

[45] Date of Patent: Dec. 29, 1992

[54] PESTICIDE APPLICATION SYSTEM ELIMINATES MANUAL PUMPING OPERATIONS AND REDUCES HANDLING OF PESTICIDE CONCENTRATES

[76] Inventor: John W. Rood, 10055 E. Mountain View Lake Dr., Apt. 2050, Scottsdale, Ariz. 85258

[21] Appl. No.: 639,576

[22] Filed: Jan. 9, 1991

[51] Int. Cl.[5] ..... B65D 1/04; B65D 3/04

[52] U.S. Cl. ..... 141/18; 141/21; 222/399; 222/394

[58] Field of Search ..... 141/21, 47, 51, 18, 141/38, 99; 222/399, 394; 137/572, 208

[56] References Cited

U.S. PATENT DOCUMENTS

| | | | |
|---|---|---|---|
| 663,732 | 12/1900 | Coughlin | 222/399 |
| 682,236 | 9/1901 | Brown | 141/18 |
| 1,892,535 | 12/1932 | Sanders | 222/399 |
| 2,160,501 | 5/1939 | Hedges et al. | 137/208 |
| 2,589,728 | 3/1952 | Pratt | 272/394 |
| 2,604,108 | 7/1952 | Considine | 137/208 |
| 3,262,609 | 7/1966 | Patras | 222/399 |
| 3,495,612 | 2/1970 | Moreland, II et al. | 222/394 |
| 3,804,299 | 4/1974 | Kain | 222/394 |
| 3,893,625 | 7/1975 | Wiggins | 137/572 |
| 3,976,227 | 8/1976 | Ray | 222/394 |

*Primary Examiner*—Henry J. Recla
*Assistant Examiner*—David J. Walczak
*Attorney, Agent, or Firm*—James F. Duffy

[57] ABSTRACT

An improved pesticide application utilizes a relatively large replenishment tank to store several working days requirements of pesticide solution at a relatively high pressure head. Both solution and pressure head, portions thereof, are transferred to a portable, working cylinder from the replenishment tank. Because a pressure head is directly transferred from the replenishment tank to the portable cylinder, rather than creating a pressure head within the cylinder solely by the transfer of solution under pressure to the cylinder, the pressure head within the portable cylinder is maintained for a significant working period. The improved pesticide application system requires the handling of concentrated pesticides and water only once every several days, rather than 3 or 4 times a day. No manual hand pumping is required to maintain a pressure head within the portable cylinder.

11 Claims, 1 Drawing Sheet

PESTICIDE APPLICATION SYSTEM ELIMINATES MANUAL PUMPING OPERATIONS AND REDUCES HANDLING OF PESTICIDE CONCENTRATES

BACKGROUND

1. Field of the Invention

The invention relates to systems wherein pesticides are mixed and sprayed. In particular, the invention relates to an improved pesticide application system which drastically reduces the frequency with which pesticide concentrates must be handled in making up mixtures of pesticide for application.

2. Prior Art

In general, persons applying pesticides within and about building sites utilize a small (about 1-gallon size) pressurized container which contains a concentrated pesticide diluted with water. The container comprises a cylinder which is pressurized by hand pumping of a pump coupled to the cylinder. The person applying the pesticide must frequently operate the hand pump to maintain a working pressure head within the cylinder. Because the cylinder is small, the operator must make frequent trips, throughout the workday, to the water spigot to mix up a new batch of pesticide spray solution. By the end of the workday, the operator's arm is sore from all the pumping required; and he is frequently annoyed with the amount of time that has been lost in the making of new pesticide solution mixes.

It is the intent and purpose of the invention disclosed herein to eliminate the continual pumping up of the pressure head within the cylinder by hand as well as obviating the need to constantly pause to make up new batches of pesticide mix.

SUMMARY OF THE INVENTION

The invention is an improvement in the prior art pesticide application system which has a cylinder in which a pesticide solution is placed. A hand pump is coupled to the cylinder and is manually operated to create a pressure head within the cylinder so that the pesticide solution will be emitted from the cylinder, under pressure, when appropriate spray valve is actuated. Because of the small size of the cylinder, the pesticide solution will have to be replenished several times during the course of the workday. Replenishment of the pesticide solution requires that the pressure within the cylinder be eliminated, the new pesticide solution installed within the cylinder, and the pressure head then recreated by manual operation of the hand pump.

The pesticide solution itself comprises a mixture of pesticide concentrate and water which is manually mixed by the pesticide application operator each time the cylinder is replenished. Most often, this mixing of pesticide and water takes place out of doors close to a water spigot at the building site being treated with the pesticide. Operator clumsiness, and the like, contribute to spillage of the pesticide concentrates such that it is absorbed into the ground in the vicinity of the water spigot or portions of it being carried off by the wind.

The improvement itself is disclosed as comprising a pesticide replenishment tank in which is placed sufficient pesticide solution for several working day's operations. A pressure head is created in the replenishment tank, which pressure head is greater than the pressure head in the small cylinder generally employed by the operator in applying pesticides. Means, for example, hoses, are used for coupling first, a portion of the pesticide solution, under pressure, from the replenishment tank to the small cylinder; and secondly, for coupling a portion f the pressure head from the replenishment tank to the small cylinder. Because the replenishment tank holds a solution sufficient for several workdays, there is a need for the operator to handle pesticide concentrates only once every several days, rather than each time the small cylinder is replenished. Also, because of the ability to transfer a pressure head from the replenishment tank into the small cylinder, the need to manually operate a hand pump each time the cylinder is replenished is obviated.

To create the pressure head within the replenishment tank, a source of pressurized gas is coupled to the replenishment tank. The source of pressurized gas is disclosed as being a container of compressed gas or an air compressor.

Because there is no need to manually operate a hand pump to pressurize the small cylinder used with the improvement, a replacement cylinder is provided which has no hand pump and which replaces the original small cylinder having a hand pump coupled to it.

Because the improved pesticide application system is conceived of as an aid to commercial pesticide application operators, the improvement conceives of a transport container for housing and transporting the improved system. The transport container may be carried in a vehicle or a trailer employed by the operator in moving from building site to building site.

DESCRIPTION OF THE DRAWINGS

FIG. 3 illustrates the manner in which the improved pesticide application system may be housed and transported, for example, on the bed of a pickup truck or the like.

A DETAILED DESCRIPTION OF THE INVENTION

Figure 1:
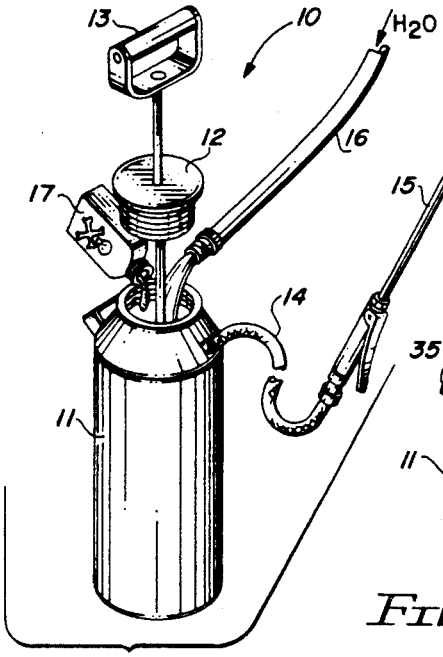
FIG. 1 (PRIOR ART)
FIG. 1 is a perspective drawing of the prior art, hand carried cylinder employed for applying pesticides.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The prior art pesticide application system 10 is illustrated in FIG. 1. The prior art system is comprised of a small, approximately 1-gallon, cylinder 31*a*. Cylinder 31*a* has a removable cap 12 which also carries the components of a manually operated pump, not shown in the illustration. Handle 13 is utilized both for transporting cylinder 31*a* well as comprising the manually actuated handle of a piston which is exercised to create a pressure head within cylinder 31*a* above the pesticide solution contained within cylinder 31*a*.

With cap 12 removed, as illustrated, poison concentrate 17 and water from water hose 16 may be mixed within cylinder 31*a* to provide a sprayable pesticide solution. Pesticide concentrate 17 may be provided either in liquid or dry form.

With a pesticide solution placed within cylinder 31*a* so as to fill cylinder 31*a*, approximately halfway, cap 12 is placed in position on cylinder 31*a*. Handle 13 is then reciprocated to actuate the pump attached to cap 12 and create a pressure head above the solution within cylinder 31*a*. Thereafter, the actuation of spray head 15 permits solution to exit cylinder 31*a* via hose 14 and spray head 15 from whence it is directed to those areas of the site to be treated.

Because cylinder 31*a* only contains approximately 1 gallon of pesticide solution, the pesticide solution within cylinder 31*a* will have to be replenished 3 or 4 times in a typical workday. Each time the poison solution is replenished, handle 13 must be reciprocated to exercise the pump to create a pressure head above the replenished solution within the cylinder. Also, in the course of spraying the solution from cylinder 31*a*, the pressure head within the cylinder is dissipated and handle 13 must be repeatedly actuated at frequent intervals during the course of spraying operation in order to eject pesticide solution from spray head 15 under pressure.

Figure 2:
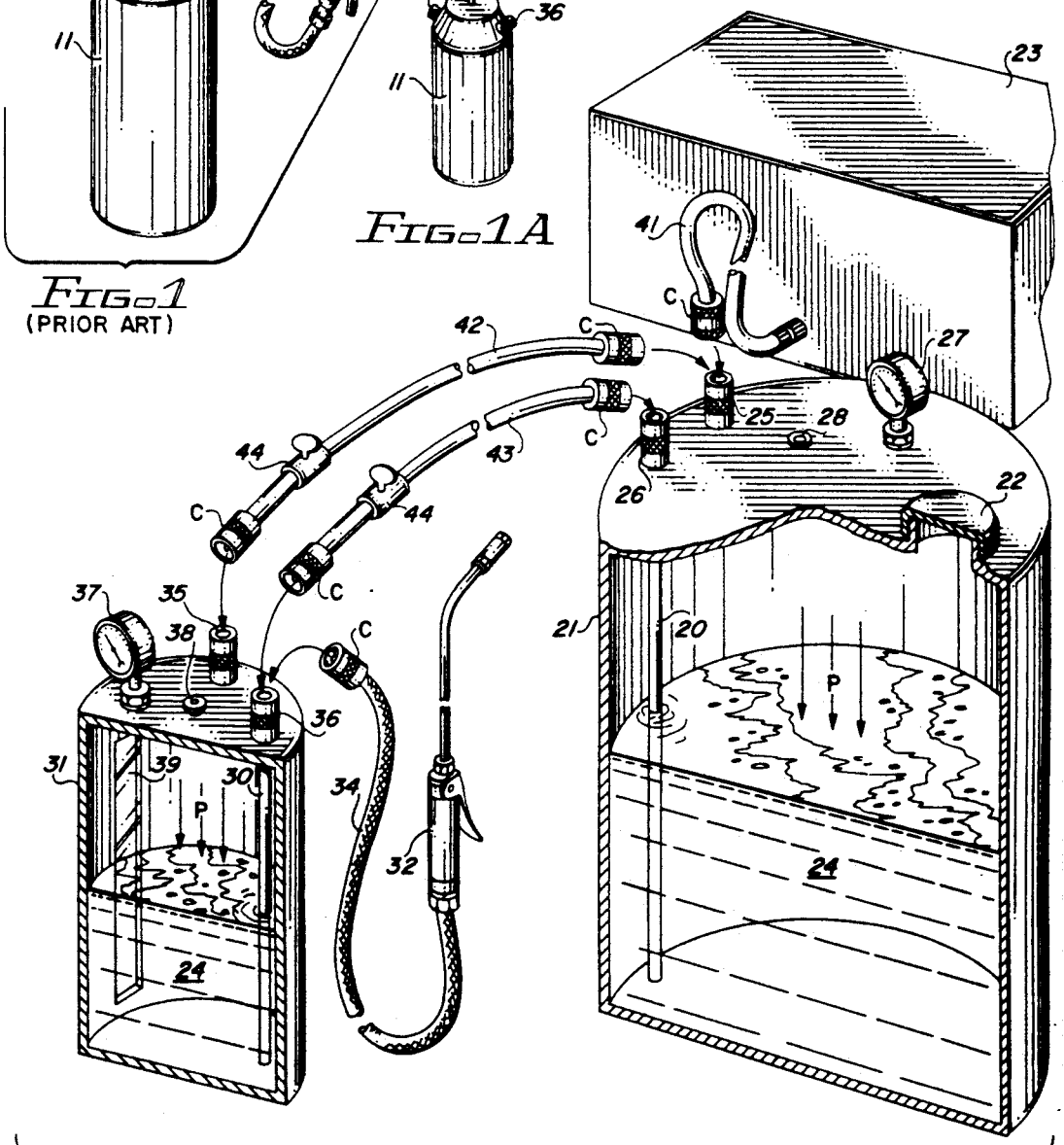
FIG. 2 illustrates the components of the improved pesticide application system and the manner in which pressure and pesticide solution are conveyed from a replenishment tank to a small cylinder utilized by the operator of the improved pesticide application system.

The necessity for repeatedly making up small batches of pesticide solution during the course of the workday endangers both the operator preparing the pesticide solution as well as the environment in which the operator performs the mixing operations. Further, it is a nuisance to the pesticide operator to have to frequently cease his work in order to actuate pump handle 13 to refurbish the pressure head in cylinder 31*a*. The improved pesticide application system illustrated in FIG. 2 is intended to avoid these shortcomings of the prior art system.

The improved pesticide application system is comprised of a replenishment tank 21 having a significantly greater volumetric capacity when compared with the prior art cylinder 31*a*. Thus, replenishment tank 21 will have a volumetric capacity of, for example, 10 to 15 gallons as compared to the typical 1-gallon capacity of prior art cylinder 11 or its 2-gallon replacement cylinder 31 of FIG. 2.

With cap 22 removed from replenishment tank 21, a sufficient quantity of pesticide solution 24 may be placed within replenishment tank 21 to satisfy the demands of several workdays of pesticide application. Thus, pesticide solution mixtures will have to be made only once every several days, rather than 3 to 4 times each working day. This reduces the number of instances in which pesticide concentrates must be handled and results in greater safety to the pesticide system operator as wall as to the environment in which the operator functions.

Replenishment tank 21 is provided with a pressure port 25 into which pressurized gas may be injected or, conversely, pressurized gas may be removed therefrom. A second port 26 is intended for the extraction of pesticide solution 24 from replenishment tank 21. To this end, pipe 20 extends from a region near the base of tank 21 to port 26. A pressure head P exerting a force on solution 24 causes a portion of that solution to rise upward into pipe 20 from which it may exit port 26 when a hose equipped with the proper coupling is connected to port 26.

A pressure gauge 27 indicates the magnitude of the pressure head P within tank 21 while a pressure release valve 28 provides means for relieving the pressure within the tank.

In order to pressurize tank 21 without manual exertion, a pressurized gas source 23 is provided. Gas source 23 may be a container of pressurized gas or, may be an air compressor. For purposes of exposition and not of limitation, gas source 23 is here taken to be an air compressor. With an air compressor as gas source 23, it is a simple matter to pressurize tank 21 by connecting hose 41 to gas port 25 on tank 21. Hose 41 is connected at one end to the pressurized gas source 23 and has a coupling C which connects to gas port 25. Couplers C and gas port 25 may be configured as quick connect/disconnect couplings wherein secure mechanical coupling is made between hose 41 and gas port 25 before gas can flow through gas port 25.

With the solution 24 made up of a mixture of concentrated pesticide and water, having been deposited within tank 21, hose 41 is now coupled to gas port 25 so that pressurized gas from source 23 may be injected into tank 21 to create a pressure head P above solution 24 within tank 21. As a practical matter, gas from pressurized source 23 may be injected through port 26 so as to enter tank 21 via pipe 20. In this event, gas emerges from the lower portion of pipe 20 and causes solution 24 to be agitated as gas bubbles up through solution 24. Such agitation will assure satisfactory mixing of the pesticide concentrate and water which make up solution 24.

At this point, replenishment tank 21 has a sufficient quantity of solution 24 to provide for 3 or 4 workdays of pesticide application and a pressure head P above solution 24 of approximately, again, for example, 150 pounds per square inch.

Figure 1A:
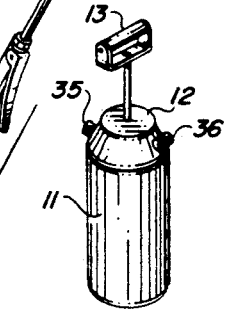
FIG. 1A shows the cylinder of FIG. 1 equipped with gas and liquid ports for use in accord with the disclosure herein.

While prior art cylinder 31*a* could be readily equipped with the necessary gas and liquid ports, 35 and 36 in FIG. 1A, to enable its use with the improved pesticide application system, the manually operated pump, which was a necessary part of cylinder 31*a* in the prior art, is no longer necessary. Thus, cylinder 31 is preferably provided as a replacement for prior art cylinder 31*a*. In the same manner as replenishment tank 21 was equipped, replacement cylinder is cylinder 31A without a manually operated pump. Cylinder 31 31 is provided with a gas port 35 and a solution port 36. From solution port 36 a pipe 30 extends downward through solution 24 to the vicinity of the base of tank 31. Solution 24 finds its way into cylinder 31 via hose 43 which is coupled at one end to port 26 on tank 21 and at the other end to port 36 on cylinder 31.

With ports 26 and 36 so coupled, solution 24 would nominally flow, under pressure, from tank 21 into cylinder 31. However, such flow is prohibited by normally closed valve 44 coupled in the fluid flow path of hose 43. Valve 44, being nominally closed, prevents the inadvertent spillage of pesticide solution 24 when either end of hose 43 is connected to the respective ports, 26 or 36, on tank 21 and cylinder 31. Only after hose 43 is coupled to both port 26 and 36 is valve 44 actuated by the operator to permit pesticide solution 24 to flow from replenishment tank 21 into cylinder 31.

Cylinder 31 may have a volumetric capacity of approximately 2 gallons. Again, this is stated not as a limitation but by way of exposition. Solution 24 from replenishment tank 21 is allowed to flow into cylinder 31 until cylinder 31 has been approximately filled to one-half its capacity. To facilitate the determination of the liquid level within cylinder 21, a window 39, in the wall of cylinder 31, or other suitable indicating means, is provided. Cylinder 31 may be of relatively lightweight plastic construction and if the walls of the cylinder are translucent, the entire cylinder may serve as window 39.

After sufficient solution 24 has been transferred from tank 21 to cylinder 31, the valve 44 on hose 43 is once again closed and hose 43 is decoupled from valves 26 and 36.

It now remains to provide a pressure head above the solution 24 within cylinder 31. To create this pressure head P within cylinder 31, hose 42 is coupled between gas port 25 of tank 21 and gas port 35 of cylinder 31. Again, a valve 44 prevents the inadvertent transfer of compressed gas as coupling is being made. When tank 21 and cylinder 31 are coupled by hose 42, valve 44 is actuated to permit compressed gases to flow from the pressure head above solution 24 within tank 21 to cylinder 31 to create a pressure head P above the solution 24 therein. A pressure head of 50 or 60 pounds per square inch is a typical, workable value which will enable the pesticide application operator to generally complete the application of pesticide to a building site without the need to replenish the pressure head or the solution within cylinder 31. In practice, a single hose may be used to serve the functions set out above with respect to hoses 42 and 43.

Cylinder 31 has a pressure release valve 38 to drain off any pressure head within cylinder 31, as may be desired.

To use cylinder 31, hose 34 is coupled to port 36 and pesticide solution 24, under pressure, travels upward through pipe 30 through hose 34 to exit spray head 32 whenever the spray head is actuated to emit solution 24.

As the pesticide application operator moves from work site to work site, it is a simple matter for him to replenish cylinder 31 from replenishment tank 21, in the manner aforesaid. No handling of pesticide concentrate is required in the course of the day and there is no need for the frequent pausing in the work routine to manually pump a pressure head into cylinder 31.

Figure 3:
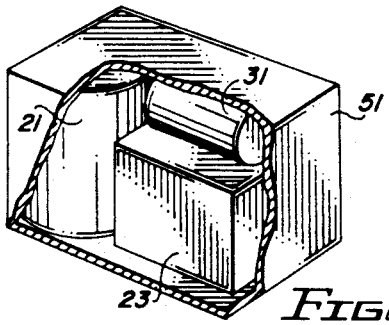

For ease of transport and to provide a means for housing the improved pesticide application system, a portable enclosure 51, shown in FIG. 3, is provided. Housing 51 is of sufficient size to accept replenishment tank 21, portable cylinder 31 and pressurized gas source 23. Gas source 23, as before mentioned, may be an air compressor. For greatest utility in the service of a commercial pesticide applicator, the air compressor may be energized by the DC electricity available in the pickup truck or the like used to transport the improved system. Housing 51 will be of convenient size to be transported on a pickup truck.

What has been disclosed herein is an improved pesticide application which utilizes a relatively large replenishment tank to store several working day's requirements of pesticide solution and a relatively high pressure head within the replenishment tank above the solution stored within the tank. Both solution and pressure head, portions thereof, are transferred to a portable, working cylinder from the replenishment tank. Because a pressure head is directly transferred from the replenishment tank to the portable cylinder, rather than creating a pressure head within the cylinder solely by the transfer of solution under pressure to the cylinder, the pressure head within the portable cylinder is maintained for a significant working period. The improved pesticide application system requires the handling of concentrated pesticides and water only once every several days, rather than 3 or 4 times a day as in the prior art. No manual hand pumping is required to maintain a pressure head within the portable cylinder.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention.

That which is claimed is:

1. In a pesticide application system having a cylinder in which a pesticide solution is placed and in which a pressure head is created by manual operation of a hand pump coupled to said cylinder, said cylinder requiring replenishment with pesticide solution several times during the course of the workday, said pressure head having to be recreated each time said solution is replenished, said pesticide solution comprising a mixture of pesticide concentrate and water manually mixed by a pesticide application system operator each time said cylinder is replenished, the improvement comprising:

a pesticide replenishment tank in which is placed a selected amount of solution selected for several working day operations and in which a pressure head is created, said pressure head being greater than said pressure head in said cylinder;

first means removably coupling said replenishment tank and said cylinder for transferring a selected portion of said pesticide solution under pressure, from said replenishment tank to said cylinder; and second means removably coupling said replenishment tank and said cylinder for transferring pressure from said pressure head from said replenishment tank to said cylinder to create a selected pressure head above said selected portion of said pesticide solution, whereby said selected amount of solution of said mixture of pesticide concentrated in water need be manually mixed only once every several days rather than each time said cylinder is replenished and the need to manually operate a hand pump each time said cylinder is replenished is obviated.

2. The improvement of claim 1 further comprising a source of pressurized gas coupled to said replenishment tank for injecting pressurized gas into said tank to create said pressure head is said tank.

3. The improvement of claim 2 wherein said source of pressurized gas is a container of compressed gas.

4. The improvement of claim 2 wherein said source of pressurized gas is an air compressor.

5. The improvement of claim 2 further comprising a transport container for housing and transporting elements of said improvement.

6. The improvement of claim 1 comprising a single hose selectively coupling at least one of a selected portion of said pesticide solution and pressure from said pressure head from said replenishment tank to said cylinder.

7. In a pesticide application system having a cylinder in which a pesticide solution is placed and in which a pressure head is created by manual operation of a hand pump, said cylinder requiring replenishment with pesticide solution several times during the course of the workday, said pressure head having to be recreated each time said solution is replenished, said pesticide solution comprising a mixture of pesticide concentrate and water manually mixed by a pesticide application system operator each time said cylinder is replenished, the improvement comprising:

a pesticide replenishment tank in which is placed a selected amount of solution selected for several working day's operations and in which a pressure head is created, said pressure head being greater than said pressure head in said cylinder;

said cylinder having a coupling port for the selected transfer of gas and solution from said replenishment tank;

first means removably coupling said replenishment tank said coupling port on said cylinder for transferring a selected portion of said pesticide solution, from said replenishment tank to said cylinder; and second means removably coupling said replenishment tank and said cylinder for transferring pressure from said pressure head from said replenishment tank to said cylinder to create a selected pressure head above said selected portion of said pesticide solution, whereby said selected amount of solution of said mixture of pesticide concentrate in water need be manually mixed only once every several days rather than each time said cylinder is replenished and the need to manually operate a hand pump each time said cylinder is replenished is obviated.

8. The improvement of claim 7 further comprising a source of pressurized gas coupled to said replenishment tank for injecting pressurized gas into said tank to create said pressure head in said tank.

9. The improvement of claim 8 wherein said source of pressurized gas is a container of compressed gas.

10. The improvement of claim 8 wherein said source of pressurized gas is an air compressor.

11. The improvement of claim 8 further comprising a transport container for housing and transporting elements of said improvement.

* * * * *